US006736962B1

(12) United States Patent
Cook et al.

(10) Patent No.: US 6,736,962 B1
(45) Date of Patent: May 18, 2004

(54) CATALYTIC STRIPPING FOR MERCAPTAN REMOVAL (ECB-0004)

(75) Inventors: Bruce Randall Cook, Stewartsville, NJ (US); Robert Charles Welch, Baton Rouge, LA (US); Richard Harry Ernst, Glen Gardner, NJ (US); William Edward Winter, Jr., Baton Rouge, LA (US); Richard Alan Demmin, Highland Park, NJ (US); Charles Alfred Euker, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/676,875

(22) Filed: Sep. 29, 2000

(51) Int. Cl.[7] ..... C10G 45/02; C10G 65/02; C10G 65/07

(52) U.S. Cl. ..... 208/210; 208/212

(58) Field of Search ..... 208/210, 212

(56) References Cited

U.S. PATENT DOCUMENTS

| | | | | | |
|---|---|---|---|---|---|
| 4,822,480 | A | * | 4/1989 | Harandi et al. | 208/212 |
| 5,554,275 | A | * | 9/1996 | Harandi | 208/213 |
| 5,906,730 | A | * | 5/1999 | Hatanaka et al. | 208/210 |
| 6,228,254 | B1 | * | 5/2001 | Jossens et al. | 208/212 |
| 6,409,913 | B1 | * | 6/2002 | Clark et al. | 208/213 |

* cited by examiner

*Primary Examiner*—Walter D. Griffin
(74) *Attorney, Agent, or Firm*—Estelle C. Bakun; Gerard J. Hughes; Jeremy J. Kliebert

(57) ABSTRACT

A process for reducing the amount of mercaptan sulfur in a petroleum stream without significantly changing its octane value. The process comprising a three-phase system wherein the petroleum stream to be treated is passed through a fixed bed of catalyst in the presence of a stripping gas. The stripping gas can be either hydrogen containing gas or an method wherein the composition of the catalyst utilized varies according to the stripping gas.

8 Claims, 3 Drawing Sheets

CATALYTIC STRIPPING FOR MERCAPTAN REMOVAL (ECB-0004)

FIELD OF THE INVENTION

A process is disclosed for decreasing the amount of sulfur in hydrocarbon streams.

BACKGROUND OF THE INVENTION

Environmentally driven regulatory standards for motor gasoline (mogas) sulfur levels will result in the widespread production of 120 ppm S mogas by the year 2004 and 30 ppm by 2006. In many cases, these sulfur levels will be achieved by hydrotreating naphtha produced from Fluid Catalytic Cracking (cat naphtha), which is the largest contributor to sulfur in the mogas pool. As a result, techniques are required that reduce the sulfur in cat naphthas without reducing beneficial properties such as octane.

Conventional fixed bed hydrotreating can reduce the sulfur level of cracked naphthas to very low levels, however, such hydrotreating also results in severe octane loss due to extensive reduction of the olefin content. Selective hydrotreating processes such as SCANfining have recently been developed to avoid massive olefin saturation and octane loss. Unfortunately, in such processes, the liberated $H_2S$ reacts with retained olefins forming mercaptan sulfur by reversion. Such processes can be conducted at severities which produce product within sulfur regulations, however, significant octane loss also occurs.

Several methods exist for removal of sulfur from hydrocarbon streams. For example, U.S. Pat. No. 3,876,532; U.S. Pat. No. 4,149,965; U.S. Pat. No. 5,423,975; and U.S. Pat. No. 5,826,373 each teach hydrotreating methods using deactivated or spent catalyst. U.S. Pat. No. 5,885,440 teaches cooling of a hydrocrackate prior to hydrotreating. U.S. Pat. No. 3,338,819 teaches hydrotreatment of a hydrocrackate over a granular catalyst bed at substantially the same conditions as used to produce the hydrocrackate.

U.S. Pat. Nos. 5,510,016; 5,308,471; 5,399,258; 5,346,609; 5,409,596; and 5,413,697 each teach hydrodesulfurization followed by treatment over an acidic catalyst to restore octane.

What is needed in the art is a process which produces sulfur levels within regulatory amounts and which minimizes loss of product octane.

SUMMARY OF THE INVENTION

A method for decreasing sulfur levels in a mercaptan sulfur containing hydrocarbon feedstream comprising the steps of passing said mercaptan sulfur containing hydrocarbon feedstream over a fixed bed catalyst in a three phase, gas, liquid, solid, system in the presence of a stripping gas, for a time and at a temperature and pressure sufficient to decompose at least a portion of said mercaptans to produce olefins, $H_2S$, as an off gas, and a hydrocarbon product stream having decreased levels of mercaptan sulfur and to disengage said hydrocarbon product stream having decreased amounts of mercaptan sulfur from said $H_2S$ and said stripping gas and wherein when said stripping gas is hydrogen, said fixed catalyst bed comprises (a) a non-reducible metal oxide or (b) a Group VIIIB metal promoted Group VIB catalyst, and wherein when said stripping gas is an inert gas, said fixed bed catalyst comprises a Group VIIIB metal promoted Group VIB catalyst.

As used herein, non-reducible metal oxides are metal oxides that will not reduce to the zero valent metal and water in flowing hydrogen at temperatures below 400° C. and include mixed metal oxides.

As used herein, inert gas, means a gas that is unreactive with unsaturated organics and organosulfur species in the mercaptan sulfur containing feed. The inert gas merely facilitates removal of the $H_2S$ gas produced.

DETAILED DESCRIPTION OF THE INVENTION

An aspect of the invention includes removing mercaptan sulfur from a mercaptan sulfur containing hydrocarbon stream in a three-phase system in the presence of a stripping gas over a mixed metal oxide catalyst.

Thus, a sulfur containing hydrocarbon stream, preferably a previously hydrodesulfurized hydrocarbon stream which still contains an amount of mercaptan sulfur, is passed to a three phase system containing a fixed bed catalyst. The system will be a three-phase system with the catalyst bed located in the hottest zone. The skilled artisan can readily identify the hottest zone for location of the catalyst bed, through, for example, use of thermocouples to read temperature throughout the reactor. The fixed catalyst bed will typically reside at the bottom of the reactor system. Typically, a tray for catalyst is present in such systems and the catalyst will be located in the tray provided.

The mercaptan sulfur containing hydrocarbon stream is reacted over the fixed catalyst bed, in the presence of a stripping gas, to produce $H_2S$ gas and olefins from said sulfur containing hydrocarbon stream. The stripping gas facilitates the disengagement of the hydrocarbon product stream, which will contain the produced olefins, having decreased levels of mercaptan sulfur from the $H_2S$ gas and allows the gases to be removed as off gases from the three phase system.

Figure 3:
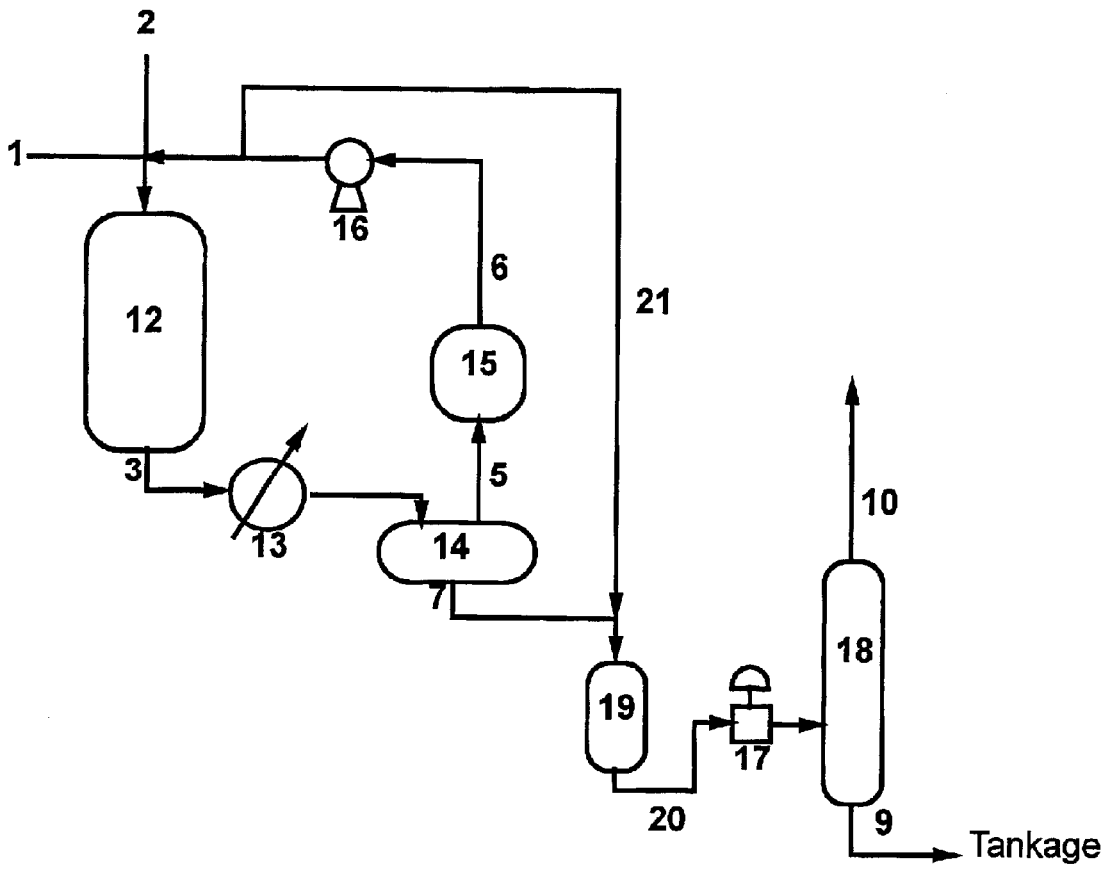
FIG. 3 depicts one possible embodiment again where the SCANfining step is included merely for convenience. A previously hydrodesulfurized feedstream (7) and stripping gas (21) enter three phase reactor (19). The product from the reactor (19) then undergoes a depressurization step (17) and enters a stripper (18) where gases (10) and product (9) are recovered. In this scheme, it is possible to utilize a much smaller three phase reactor and provide additional stripping of hydrogen sulfide, if necessary, in a subsequent step. Such a flow scheme would be beneficial when carrying out the invention in a concurrent flow reactor.

Any suitable three-phase systems can be employed in the instant invention. For example, a stripper having a fixed catalyst bed in the hottest zone can be employed to accomplish the sulfur removal described herein. Additionally, a fixed bed reactor, such as the one depicted in FIG. 3, where the temperature is maintained below the dew point of the hydrocarbon mixture contained within the reactor, so that a substantial portion of the hydrocarbon feed is maintained in the liquid phase may be utilized. Other systems known to the skilled artisan may also be employed. Preferably, in such a system, the temperature will be maintained at least about 5°, preferably at least about 10° C. below the dew point. Furthermore, the temperature should remain above about 200, preferably above about 250° C. By substantial portion is meant at least about 20%. In operating the invention in this manner, a further stripping step to remove hydrogen sulfide may be employed as shown in FIG. 3.

The invention accomplishes the sulfur removal without any significant change in octane of the hydrocarbon stream being acted upon. By significant is meant, no more than about 0.5 number modification in octane number.

The catalyst utilizable for the fixed bed catalyst, when hydrogen is the stripping gas is a non-reducible metal oxide or mixed metal oxide. Non-reducible metal oxides are defined as metal oxides that will not reduce to the zero valent metal and water in flowing hydrogen at temperatures below 400° C. Non-limiting examples of such oxides include $\gamma$-$Al_2O_3$, $SiO_2$, $SiO_2$—$Al_2O_3$, and MgO and mixtures thereof. If hydrogen is utilized as the stripping gas in the process $\gamma$-$Al_2O_3$ is the preferred catalytic material. Preferably, the catalysts will be sulfided catalysts.

If the stripping gas utilized is an inert gas or hydrogen, the catalyst is a supported group VIIIB metal promoted group VIB catalyst and the inert gas is a non-hydrogenating inert gas. Catalyst examples include, supported and bulk cobalt and nickel promoted molybdenum sulfide catalysts well known in the art, specifically a supported cobalt promoted molybdenum sulfide. Examples of a non-hydrogenating inert gases include nitrogen, helium, argon, methane, natural gas, lighter hydrocarbons in the liquid that are volatilized upon heating (light ends) and mixtures thereof. Light ends are defined as hydrocarbons that have boiling points below the temperature of the reactor.

When hydrogen is utilized as the stripping gas with a hydrogenating catalyst such as CoMoS it is preferred that the amount of stripping hydrogen be minimized. This can be accomplished by minimizing the treat rate of hydrogen. The hydrogen treat rate should be 25–1000 SCF/B (4.5 $m^3/m^3$ to 180 $m^3/m^3$), more preferably 25–500 SCF/B (4.5 $m^3/m^3$ to 90 $m^3/m^3$), most preferably 25–250 SCF/B (4.5 $m^3/m^3$ to 45 $m^3/m^3$). The hydrogen utilized, can be supplied as part of a gas stream comprising hydrogen, e.g. from a powerformer off gas, thereby leading to a completely integrated refinery process. Notably, the hydrogen stripping gas should contain no more than ½ mole percent of $H_2S$ One skilled in the art will readily recognize that the amount of hydrogen utilized with the Group VIIIB promoted Group VIB catalysts must be controlled to prevent a significant loss of octane. However, by utilizing a hydrogen stream, both mercaptan and thiophenic sulfur can be removed from the hydrocarbon feedstream being acted upon.

Figure 1:
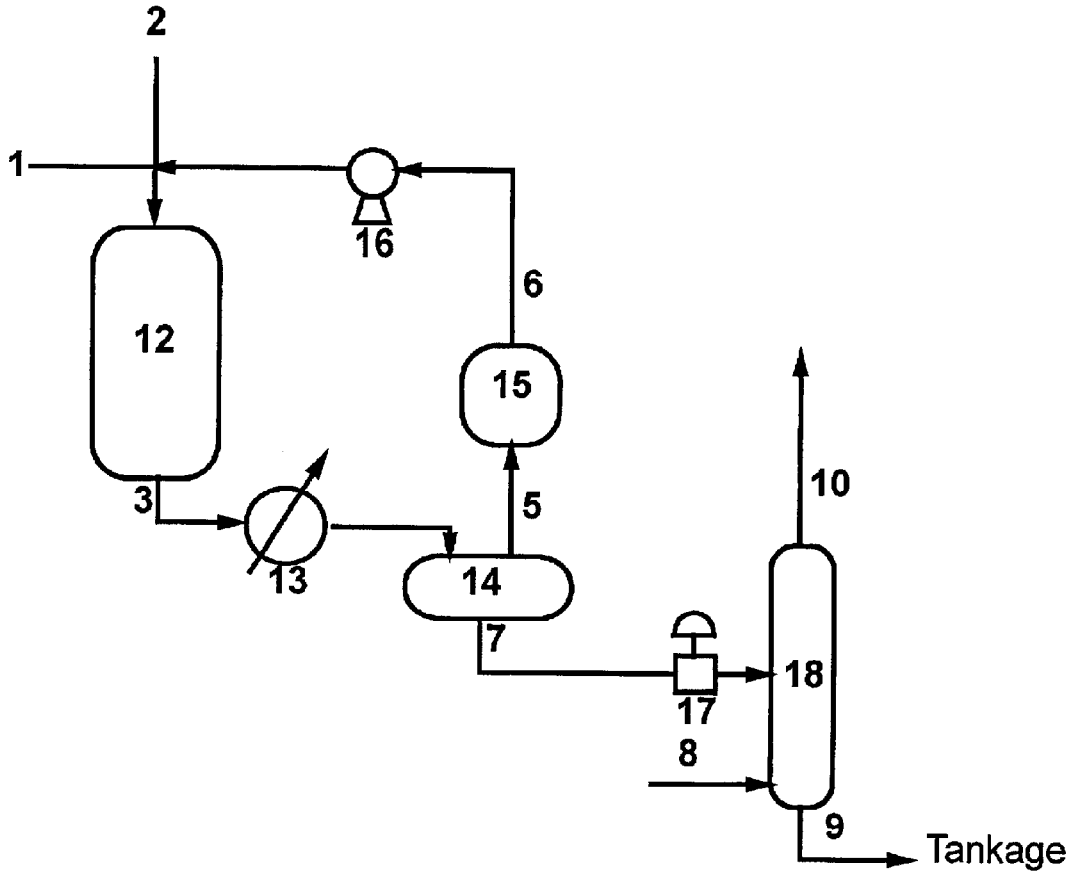
FIG. 1 depicts a typical SCANfining process.
Figure 2:
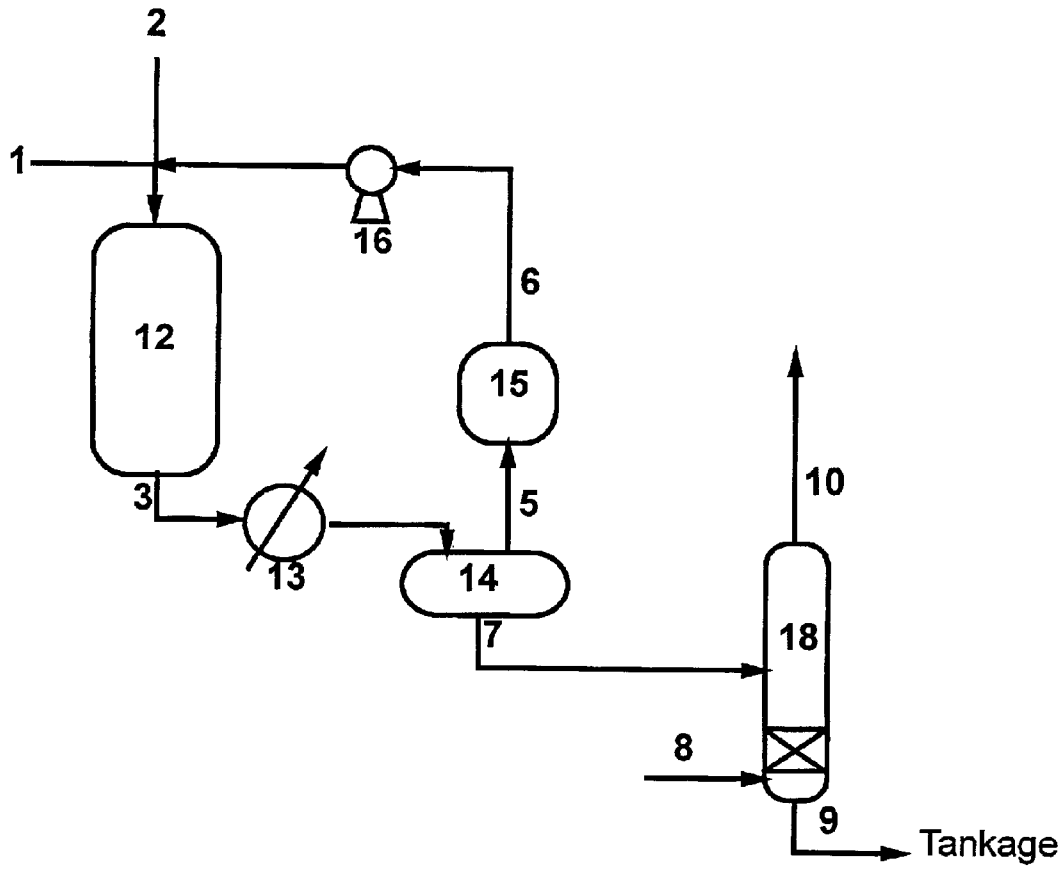
FIG. 2 depicts one possible embodiment of the invention. The typical SCANfining process flow scheme is included for convenience, however, all that is required in the instant invention is that the stream being treated be previously hydrodesulfurized. Hence, the Figure depicts a previously hydrodesulfurized (SCANfined) feedstream (7) containing mercaptan sulfur entering a three phase reactor (18) with a fixed catalyst bed along with a stripping gas (8) and hydrogen sulfide and gas exiting at (10) and desulfurized product at (9).

Thus, an example of one embodiment of the invention where the mercaptan sulfur containing feedstream is a hydrodesulfurized (SCANfined) feedstream is depicted in the FIG. 2. Olefinic naphtha (Stream 1), such as catalytic cracked and steam cracked naphtha are mixed with hydrogen (Stream 2) and reacted in a selective naphtha hydrofining reactor (Reactor 12). The organic sulfur compounds in the olefinic naphtha feed are predominantly thiophenes. The vapor product of the selective naphtha (Stream 3) contains significantly lower levels of thiophenic sulfur and hydrogen sulfide but still contains significant quantities of olefins and mercaptan sulfur. The mercaptans in Stream 3 are produced through reaction of product hydrogen sulfide with feed olefins. Stream 3 is then cooled in Heat Exchanger 13 such that the C5+ fraction is liquefied in Separation Drum 14. The overhead sour gas stream (Stream 5) which contains unreacted hydrogen and the majority of the product hydrogen sulfide is sent to Scrubber vessel 15 where hydrogen sulfide is removed to produce a sweet hydrogen stream (Stream 6). Stream 6 is compressed in Compressor 16 to the operating pressure of the Reactor 12 where it is utilized for the hydroprocessing reaction. The liquid product (Stream 7) from Separation Drum 14, contains lower levels of organo sulfur, both as thiophenes and mercaptans, in addition to olefins, paraffins, aromatics, and dissolved hydrogen sulfide. Though, in a typical process, this stream would be depressurized through a pressure relief (number 17 in FIG. 1) and sent to a stripper (18), the depressurization step is omitted in the embodiment of the process shown in FIG. 2 process. In stripper 18 stream 7 is contacted with an inert gas over a fixed bed catalyst to produce hydrogen sulfide, which exits with the inert gas in stream 10. The stripper reactor may be filled with catalyst coated packings, but it is preferred that the catalyst be loaded onto bubble trays in order to maximize residence time in the reaction zone of the stripper.

Another embodiment of this invention would be the use of a three-phase fixed bed reactor shown as Reactor 19 in FIG. 3. In this process the liquefied desulirized naphtha (Stream 7) is reacted with a hydrogen or non-hydrogenating stripping gas in a fixed bed reactor containing catalyst. The temperature of this reactor is maintained at a temperature below the dew point of the feed mixture. The product of this reactor (Stream 20) is depressurized (Pressure let down 17) followed by removal of dissolved hydrogen sulfide here in a stripper 18. Alternatively, a flash drum could be used in place of the stripper, for example.

The three phase reactor system of the invention (in the example above, a stripper) is operated at pressures of at least about 115 psi (791 kPa), more preferably greater than 150 psi (1034 kPa), and most preferably greater than 200 psi such that the temperature of bottom of the vessel where the catalyst bed will be located is established by the boiling point of the heaviest components in the feed at the pressure of the vessel. The higher the pressure the higher the temperature of the catalyst zone. It is preferred that the catalyst zone temperature be above 200° C., more preferably above 225° C. and most preferably above 250° C. Preferably, the temperature will not exceed 400° C. The amount of stripping gas added should not exceed the amount that would increase the dew point of the reactor to a temperature below that of the desired operating temperature. The gas flow rates would typically be 25 to 750 SCF/B (4.5 to 139 $m^3/m^3$), more preferably 25 to 500 SCF/B (4.5 to 90 $m^3/m^3$). The conditions selected favor mercaptan destruction kinetics and thermodynamics.

In a preferred embodiment, the three-phase reactor system is operated in a concurrent or counter current fashion with the countercurrent fashion being preferred. In counter current mode the liquid and gas move in opposite directions of each other. Typically liquid is injected in the top or middle of the vessel and flows downward exiting the bottom of the vessel. Gas is injected in the bottom of the reactor and moves upward through the liquid phase, thereby stripping dissolved gaseous components, exiting through the top of the vessel.

Because the selective removal or conversion of mercaptans from a previously hydrodesulfurized hydrocarbon stream is readily accomplished by the instant invention, it is possible to operate the HDS unit to achieve a higher total sulfur level, thereby preserving feed olefins and octane and then perform the method of the invention to remove the mercaptans affording an integrated process for producing a high quality product. Hence, less severe HDS conditions can be employed when an HDS step is coupled with the process herein described since the mercaptans from the HDS process can be readily decreased or removed in the process.

For example, an intermediate cat naphtha can be hydroprocessed to 60 wppm total sulfur where approximately 45 wppm sulfur is mercaptan sulfur. This first product would not meet the future 30 wppm sulfur specification. This product would then be treated with the method of sulfur removal described herein as the mercaptan sulfur containing feedstream in a three phase reactor with a fixed bed catalyst where the sulfur level would be reduced to approximately 20 wppm total sulfur, meeting environmental specifications. By not hydroprocessing the intermediate cat naphtha directly to 20 wppm sulfur, olefin saturation will be less than is obtained from hydroprocessing to 20 wppm directly. Thus, considerable octane is preserved affording an economical and regulatory acceptable product.

If it is desired to hydrodesulfurize the sulfur containing feedstream prior to passing it to the three-phase reactor with fixed bed catalyst described herein, any hydrodesulfurization process known in the art can be utilized.

Preferably, the feedstream to the three phase reactor will have less than 30 ppm of non-mercaptan sulfur, more preferably the feedstream will have less than 30 ppm non-mercaptan sulfur and greater than 30 ppm of mercaptan sulfur. Any hydrodesulfurization step capable of producing such feedstreams can be conducted prior to the three phase reactor process herein described and the resultant product sent to the three-phase reactor.

If it is desired to hydrodesulfurize the mercaptan sulfur containing hydrocarbon feedstream to produce increased quantities of mercaptans and retain olefins prior to the treatment herein, any technique known in the art can be utilized. For example, the hydrotreated hydrocarbon stream can be hydrodesulfurized to produce a sulfur containing hydrocarbon stream which contains non-mercaptan sulfur at a level below the mogas specification as well as significant amounts of mercaptan sulfur. Generally, such processing conditions will fall within the following ranges: 475–600° F. (246–316° C.), 150–500 psig (1136–3548 kPa) total pressure, 100–300 psig (791–2170 kPa) hydrogen partial pressure, 1000–2500 SCF/B hydrogen treat gas, and 1–10 LHSV.

The preferred hydroprocessing step to be utilized if prior HDS is desired, is SCANfining. However, other selective cat naphtha hydrodesulfurization processes such as those taught by Mitsubishi (see U.S. Pat. Nos. 5,853,570 and 5,906,730) can likewise be utilized herein. SCANFINING is described in National Petroleum Refiners Association paper # AM-99-31 titled "Selective Cat Naphtha Hydrofining with Minimal Octane Loss" and U.S. Pat. Nos. 5,985,136 and 6,013,598 herein incorporated by reference. Selective cat naphtha HDS is also described in U.S. Pat. Nos. 4,243,519 and 4,131,537.

Typical SCANfining conditions include one and two stage processes for hydrodesulfurizing a naphtha feedstock comprising reacting said feedstock in a first reaction stage under hydrodesulfurization conditions in contact with a catalyst comprised of about 1 to 10 wt. % $MoO_3$; and about 0.1 to 5 wt. % CoO; and a Co/Mo atomic ratio of about 0.1 to 1.0; and a median pore diameter of about 60 [Angstrom] to 200 [Angstrom]; and a $MoO_3$ surface concentration in g $MoO_3/m^2$ of about $0.5\times10^{-4}$ to $3\times10^{-4}$; and an average particle size diameter of less than about 2.0 mm; and, optionally, passing the reaction product of the first stage to a second stage, also operated under hydrodesulfurization conditions, and in contact with a catalyst comprised of at least one Group VIII metal selected from the group consisting of Co and Ni, and at least one Group VI metal selected from the group consisting of Mo and W, more preferably Mo, on an inorganic oxide support material such as alumina The SCANFINING reactor can be run at sufficient conditions such that the difference between the total organic sulfur (determined by x-ray adsorption) and the mercaptan sulfur (determined by potentiometric test ASTM3227) is at or below the desired (target) specification (typically 30 ppm for non-mercaptan sulfur). This stream is then sent to the three-phase system described herein for mercaptan removal.

The three phase system method described herein is particularly capable of removing $\geqq C_5$+ mercaptan sulfur.

The product from the instant process is suitable for blending to make motor gasoline that meets sulfur specifications of $\leqq$30 ppm range.

The following examples, which are meant to be illustrative and not limiting, illustrate the potential benefit of the invention, by showing specific cases in which a selective hydrofining process has been operated to produce varying levels of total and mercaptan sulfur. By reference to these cases, it should be apparent that coupling such selective hydrotreating with a subsequent mercaptan removal technology will result in improved ability to produce low sulfur products with reduced losses of olefins and octane.

The following example is illustrative and not meant to be limiting.

EXAMPLE 1

A flow through catalytic test was conducted to test catalytic materials and stripping gases for a catalytic stripping reactor. A fixed bed reactor was loaded with either 5 cc of a commercial $\gamma$-$Al_2O_3$ or a commercial cobalt promoted molybdenum sulfide hydrotreating catalyst (CoMoS). The cobalt promoted molybdenum catalyst was pre-sulfided with hydrogen sulfide. A previously hydrotreated intermediate cat naphtha feed was reacted over these two catalysts at 260° C., 235 psia pressure (1620 kPa), 2.0 LHSV, and with 675 SCF/B (122 $m^3/m^3$) of either hydrogen or nitrogen. These conditions were chosen to mimic those in the bottom of a high pressure-stripping reactor. The hydrotreated intermediate cat naphtha had a total sulfur of 60 wppm and mercaptan sulfur content of 43 wppm, and a bromine number of 20. As can be seen in the table below, alumina with hydrogen as the stripping gas results in 56% conversion of the mercaptan sulfur with no saturation of the olefins. When nitrogen is used as the stripping gas alumina rapidly deactivates and almost no conversion is observed. The CoMoS catalyst with hydrogen removes almost all the sulfur including some of the non-mercaptan sulfur, but undesirable saturation of the olefins is observed. When nitrogen is used as the stripping gas CoMoS removes approximately 95% of the mercaptan sulfur and no undesired olefin saturation is observed. CoMoS showed no apparent deactivation with nitrogen as the stripping gas.

TABLE

| | Catalyst | | | |
|---|---|---|---|---|
| | $\gamma$-$Al_2O_3$ | $\gamma$-$Al_2O_3$ | CoMoS | CoMoS |
| Stripping Gas | $H_2$ | $N_2$ | $H_2$ | $N_2$ |
| wppm Sulfur (XRF) | 36 | 53 | 5 | 20 |
| Bromine Number | 18.5 | 18.8 | 12.8 | 18.7 |

What is claimed is:

1. A method for decreasing sulfur levels in an olefinic naphtha feedstream comprising the steps of (1) passing the olefinic naphtha feedstream to a hydrodesulfurization zone under hydrodesulfurization conditions to produce a mercaptan sulfur containing olefinic naphtha feedstream containing less than 30 wppm of non-mercaptan sulfur, and (2) passing the product from step (1) over a fixed bed catalyst in a three phase, gas, liquid, solid, system in the presence of a stripping gas, for a time and at a temperature and pressure sufficient to decompose at least a portion of said mercaptans to produce olefins, $H_2S$ as an off gas, and a hydrocarbon product stream having decreased amounts of mercaptan sulfur from said $H_2S$ and said stripping gas, and wherein when said stripping gas is a gas stream comprising hydrogen, said fixed catalyst bed consists essentially of a non-reducible metal oxide, and wherein when said stripping gas consists essentially of a non-hydrogenating inert gas, said fixed bed catalyst comprises a Group VIIIB metal promoted Group VIB catalyst.

2. The method of claim 1 wherein said inert gas is selected from helium, nitrogen, argon, methane, natural gas, light ends and mixtures thereof.

3. The method of claim 1 wherein said non-reducible metal oxide catalyst is selected from alumina, silica-alumina, magnesium oxide, and mixtures thereof and said Group VIIIB promoted Group VIB catalyst is selected from the group consisting of cobalt, and nickel promoted molybdenum catalysts.

4. The method of claim 3 wherein said catalysts are sulfided catalysts.

5. The method of claim 1 wherein said hydrodesulfurization step is a selective hydrodesulfurization step wherein sulfur is removed without substantially saturating olefins and without substantially changing the octane number.

6. The method of claim 1 wherein said three phase system is a countercurrent system.

7. The method of claim 1 wherein said three phase system is a concurrent system.

8. The method of claim 1 wherein said mercaptan sulfur containing olefinic naphtha feedstream contains less than 30 ppm of non-mercaptan sulfur and greater than 30 ppm of mercaptan sulfur.

* * * * *